US007658339B2

(12) United States Patent
Prociw et al.

(10) Patent No.: US 7,658,339 B2
(45) Date of Patent: Feb. 9, 2010

(54) MODULAR FUEL NOZZLE AIR SWIRLER

(75) Inventors: Lev Alexander Prociw, Elmira (CA); Harris Shafique, Longueull (CA)

(73) Assignee: Pratt & Whitney Canada Corp., Longueuil, Quebec (CA)

( * ) Notice: Subject to any disclaimer, the term of this patent is extended or adjusted under 35 U.S.C. 154(b) by 49 days.

(21) Appl. No.: 11/960,761

(22) Filed: Dec. 20, 2007

(65) Prior Publication Data

US 2009/0159725 A1 Jun. 25, 2009

(51) Int. Cl.
*B05B 7/10* (2006.01)
*B05B 7/06* (2006.01)

(52) U.S. Cl. ..... 239/406; 239/403; 239/405; 239/423; 239/424

(58) Field of Classification Search ..... 239/403–406, 239/423, 424, 418, 421, 424.5, 533.2
See application file for complete search history.

(56) References Cited

U.S. PATENT DOCUMENTS

| | | | | |
|---|---|---|---|---|
| 3,790,086 | A * | 2/1974 | Masai | 239/406 |
| 5,722,032 | A * | 2/1998 | Gay | 419/6 |
| 6,119,459 | A * | 9/2000 | Gomez et al. | 60/748 |
| 6,289,677 | B1 * | 9/2001 | Prociw et al. | 60/748 |
| 6,560,964 | B2 * | 5/2003 | Steinhorsson et al. | 60/740 |
| 6,863,228 | B2 * | 3/2005 | Mao et al. | 239/399 |
| 7,117,678 | B2 * | 10/2006 | Sampath et al. | 60/740 |
| 7,237,730 | B2 * | 7/2007 | Prociw et al. | 239/406 |

* cited by examiner

*Primary Examiner*—Len Tran
*Assistant Examiner*—James S Hogan
(74) *Attorney, Agent, or Firm*—Ogilvy Renault LLP

(57) ABSTRACT

A modular fuel nozzle air swirler for a gas turbine engine has a body defining a fuel passage extending between an inlet end and a discharge end of the body. An annular cap is removably secured to the discharge end of the body via cooperating interlocking members.

17 Claims, 4 Drawing Sheets

MODULAR FUEL NOZZLE AIR SWIRLER

TECHNICAL FIELD

The technical field of the invention relates generally to gas turbine engines and, more particularly, to a fuel nozzle air swirler for use in gas turbine engines.

BACKGROUND OF THE ART

Fuel nozzles are used to deliver a fuel/air mixture to combustors of gas turbine engines. The discharge end of such fuel nozzles and especially the air swirler thereof is exposed to elevated temperatures and to the harsh environment inside the combustor, and, is therefore subject to fretting and oxidation damage. Conventionally, once the damage on the air swirler of the fuel nozzle becomes too severe, the entire nozzle must be replaced. Due to the geometric configuration of the nozzles and the materials that are typically used for such nozzles, the manufacturing costs associated with producing these fuel nozzle can be relatively high.

Accordingly, there is a need to provide a solution for reducing the costs associated with replacing damaged fuel nozzles that are used in gas turbine engines.

SUMMARY

It is therefore an object of the present invention to provide a fuel nozzle air swirler that addresses the above-mentioned concerns.

According to one broad aspect there is provided a modular fuel nozzle air swirler for a gas turbine engine, the nozzle comprising: a body defining a fuel passage extending between an inlet end and a discharge end of the body, the discharge end having a peripheral end surface, the body having at least one first interlocking member; and an annular cap having a shoulder surface interfacing with the peripheral end surface of the body, the annular cap having at least one second interlocking member cooperating with the at least one first interlocking member, the peripheral end surface of the body and the shoulder surface defining a plurality of through air channels.

According to another aspect, there is provided a fuel nozzle air swirler for a gas turbine engine, the nozzle comprising: a body having a central fuel passage extending therethrough and exiting the body through a spray orifice; and an annular cap positively secured to the body via cooperating securing means provided on the cap and body, the annular cap circumscribing the spray orifice, a plurality of through air channels being defined at an interface between the body and the annular cap and extending towards the central fuel passage.

According to a further aspect, there is provided a fuel nozzle air swirler assembly for use in a gas turbine engine, the assembly comprising: a body defining a central fuel passage extending between an inlet end and a discharge end of the body, the discharge end having a peripheral end surface, the peripheral end surface having a plurality of circumferentially spaced through slots extending substantially radially about the central fuel passage; and an annular cap having a shoulder surface for interfacing with the peripheral end surface of the body and cooperating with the slots to define through air channels, the cap being positively secured to the body via a latching mechanism provided on the cap and body.

Further details of these and other aspects of the present invention will be apparent from the detailed description and figures included below.

DESCRIPTION OF THE DRAWINGS

Reference is now made to the accompanying figures, in which.

DETAILED DESCRIPTION OF THE PREFERRED EMBODIMENTS

Figure 1:
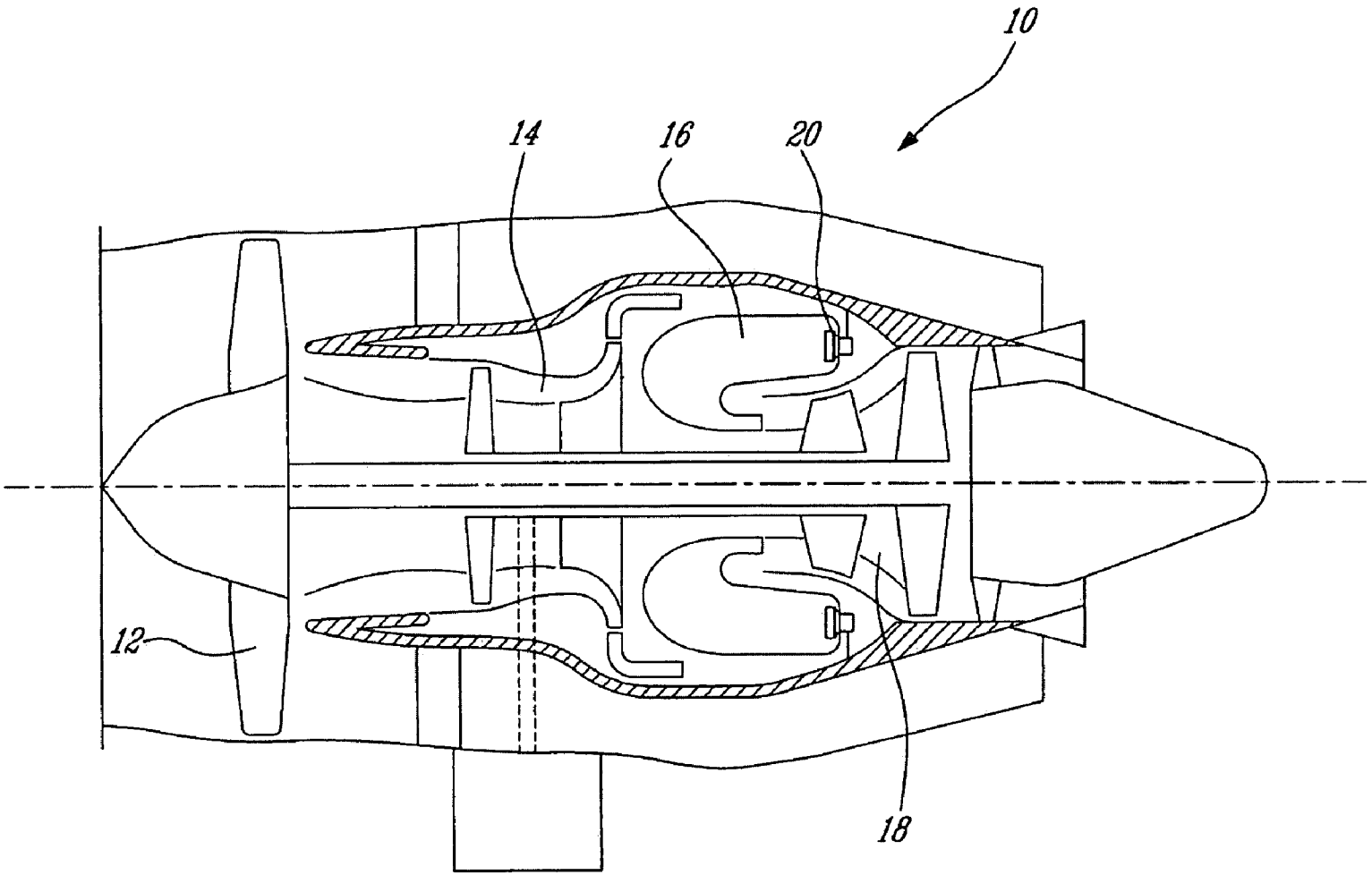
FIG. 1 is a schematic axial cross-section view of a gas turbine engine.

FIG. 1 illustrates a gas turbine engine 10 of a type preferably provided for use in subsonic flight, generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases. The fuel is supplied to the combustor 16 via fuel nozzles whereby it is also mixed with the compressed air flowing through the air swirlers of the fuel nozzles. It will be understood however that the invention is equally applicable to other types of gas turbine engines such as a turbo-shaft, a turbo-prop, or auxiliary power units.

Figure 2:
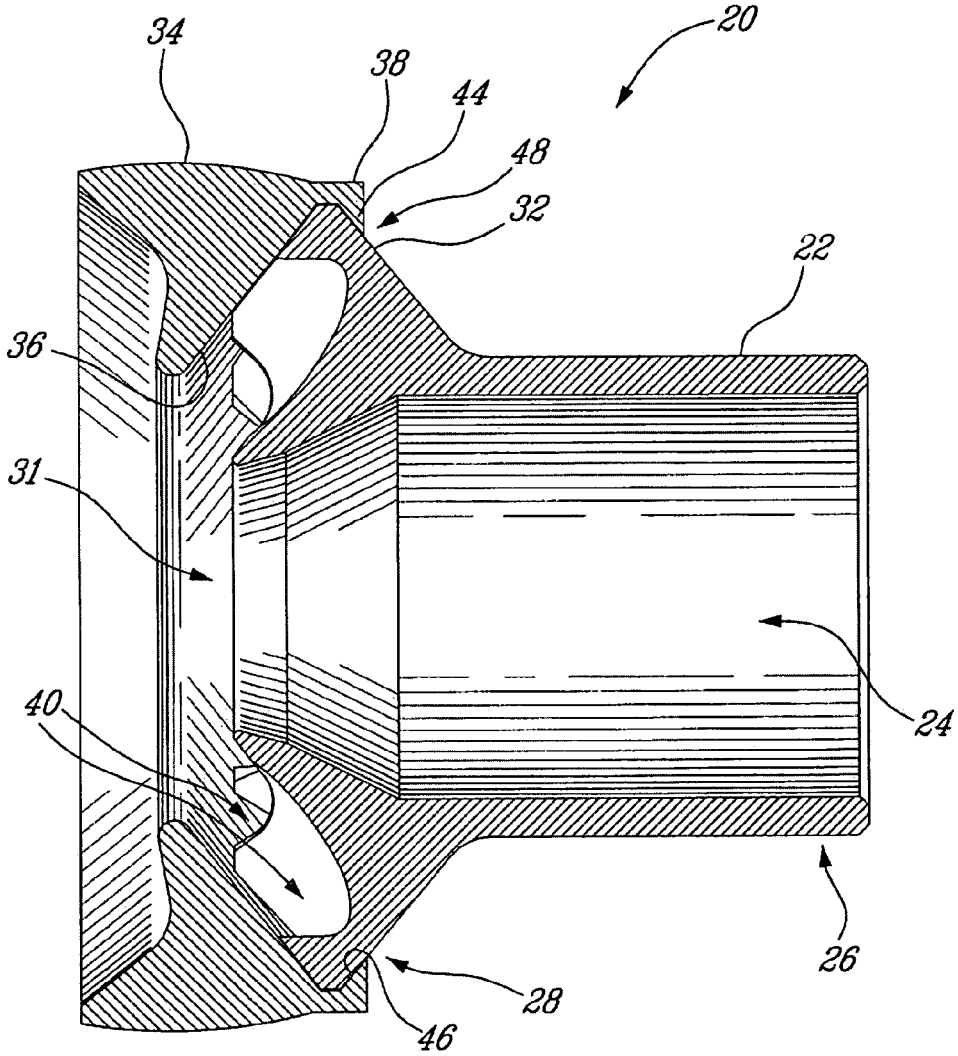
FIG. 2 is an axial cross-section view of a fuel nozzle air swirler according to one embodiment of the present invention.
Figure 3:
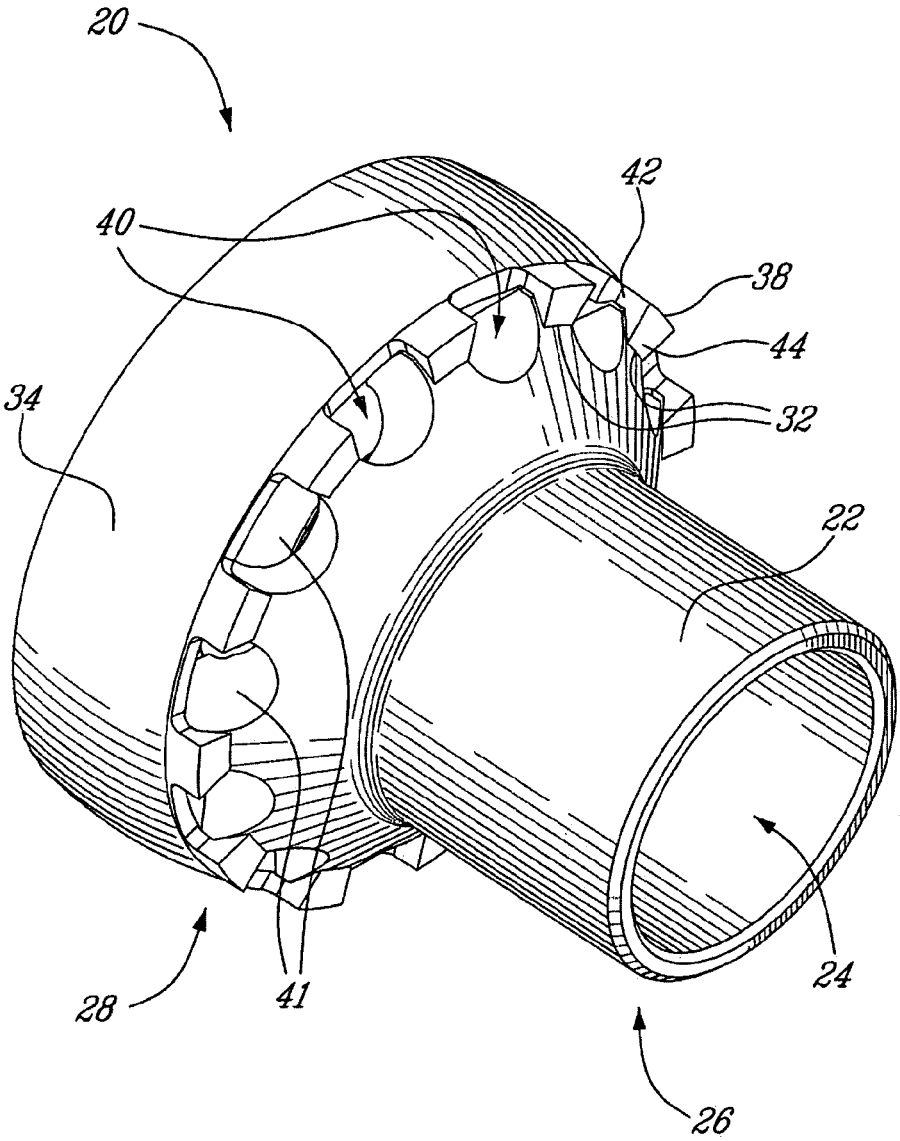
FIG. 3 is an isometric rear view of the fuel nozzle air swirler of FIG. 2.
Figure 4:
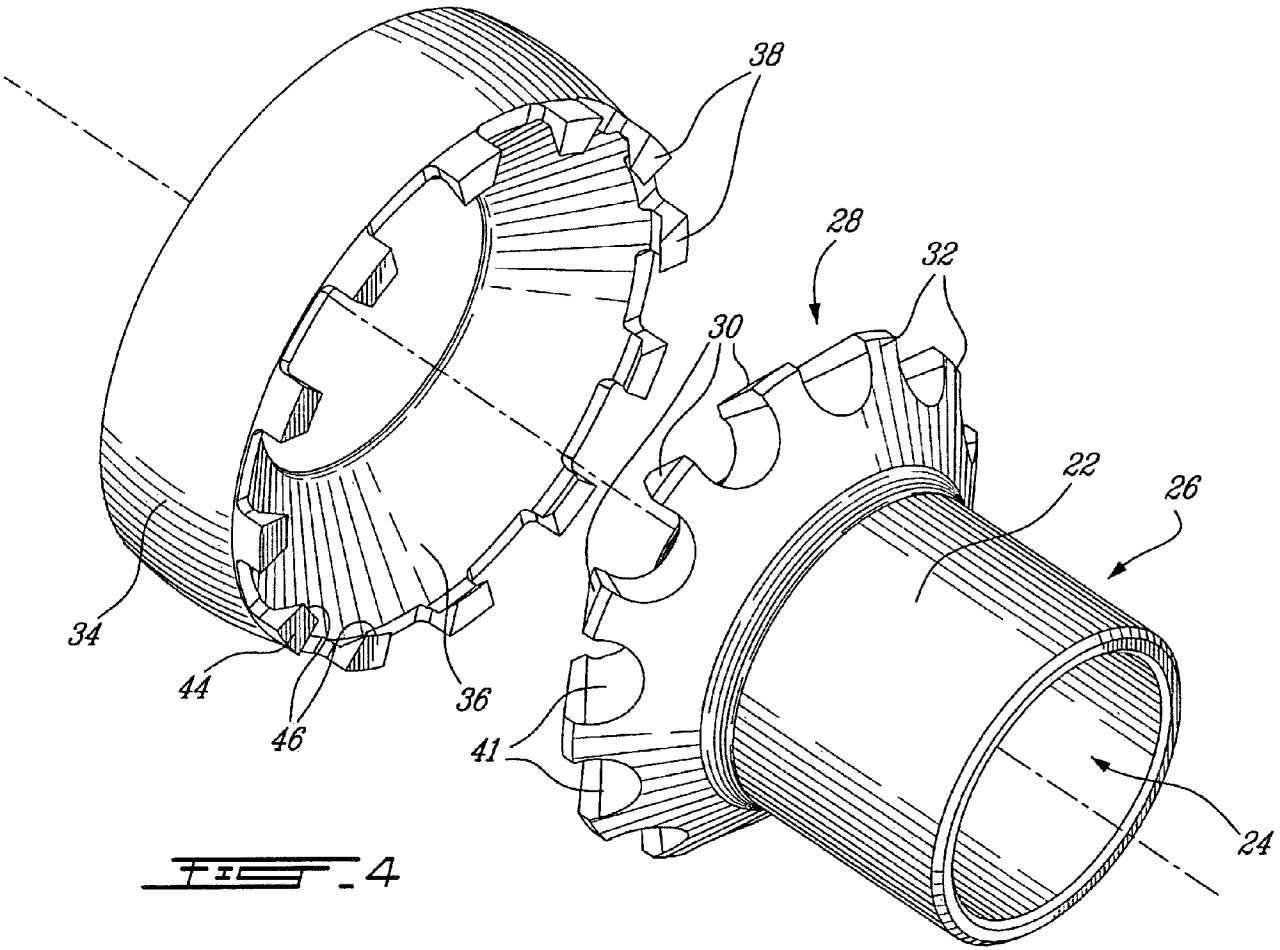
FIG. 4 is an isometric rear view of the fuel nozzle air swirler of FIG. 2 in a disassembled state.

Referring now to FIGS. 2-4, a fuel nozzle air swirler in accordance with one embodiment of the present invention is generally shown at 20. The fuel nozzle air swirler comprises a body 22 defining a fuel passage generally shown at 24 extending between an inlet end generally shown at 26 and a discharge end generally shown at 28 (FIG. 4). The fuel passage 24 may be adapted to receive a fuel delivery probe connected to a fuel supply (both not shown). The distal end of the body 22 has a peripheral end surface 30 (shown in FIG. 4) surrounding a spray orifice, generally shown at 31, of the fuel passage 24. The body 22 has a plurality of first interlocking members in the form of catches 32. The fuel nozzle air swirler 20 also comprises an annular cap 34 circumscribing the spray orifice 31. The cap 34 has a shoulder surface 36 interfacing with the peripheral end surface 30 of the body 22. The annular cap 34 has a plurality of second interlocking members in the form of latches 38 cooperating with the catches 32.

The peripheral end surface 30 of the body 22 and the shoulder surface 36 define a plurality of through air channels generally shown at 40, at the interface between the annular cap 34 and the body 22. The channels 40 extend substantially radially about the spray orifice 31. The air channels 40 extend through the fuel nozzle air swirler 20 and are defined by circumferentially distributed through slots 41 extending across the peripheral end surface 30, and, the shoulder surface 36 of the annular cap 34. The air channels 40 are use to deliver air into the combustor 16 and also to interact with the fuel as it exits the spray orifice 31. The air channels 40 may be oriented to also comprise a tangential and/or axial, component in relation to the central fuel passage 24 so as to promote atomisation of the fuel and/or induce a swirling motion of the air/fuel mixture as it enters the combustor 16. Accordingly, the term "substantially radially" mentioned above is intended to encompass orientations that have a radial component but that may not necessarily be purely radial.

The latches 38 are integrally formed with the cap 34 and comprise an arm portion 42 and a protrusion 44 located at a distal end of the arm portion 42. Each protrusion 44 extends in a radially inward direction from the arm portion 42 and defines an inside holding surface 46 identified in FIGS. 2 and 4.

The cap 34 and the body 22 are manufactured as separate parts and are subsequently assembled to form the nozzle air swirler 20. The latches 38 cooperate with the catches 32 in order to positively secure the cap 34 to the body 22. In order to assemble the cap 34 to the body 22, the cap 34 may be assembled onto the discharge end 28 of the body 22 by inserting the latches 38 into the slots 41 and bringing the cap 34 and the body 22 together until the shoulder surface 36 comes in contact with the peripheral end surface 30, and then, turning the cap 34 relative to the body 22 so that the inside holding surfaces 46 of the latches 38 engage the catches 32 so as to prevent axial movement between the cap 34 and the body 22. This provides a positive securing arrangement of the cap 34 and the body 22. The slots 41 are configured to have a width that is greater than the width of the latches 38. In order to provide additional holding capacity between the cap 34 and the body 22, the cap 34 may be welded or brazed to the body 22. The weld (not shown) may be located at location 48 and may comprise a spot weld between at least one of the latches 38 and at least one of the catches 32.

Alternatively, depending on the mechanical properties and the specific configuration of the latches 38, the cap 34 may be assembled to the body 22 by axially pressing the cap 34 against the discharge end 28 of the body 22 and essentially "snapping" the cap 34 to the body 22. Provided that the arm portions 42 of the latches 38 are sufficiently resilient, as the cap 34 is pressed against the discharge end 28 of the body 22, the protrusions 44 slide against the peripheral end surface 30 and the arm portions 42 resiliently bend outwardly until a radially outward portion of the peripheral end surface 30 is reached. The peripheral end surface 30 has a frustro-conical configuration which provides self-centering of the cap 34 and body 22. Once the protrusions 44 have slid passed the peripheral end surface 30, the arm portions 42 return to their undeflected state and the inside holding surfaces 46 of the protrusions 44 then engage the catches 32. Again, the cap 34 may further be welded or brazed to the body 22.

In use, it is typically an outlet end of fuel nozzles that suffers damage caused by the harsh environment inside the combustor 16. Advantageously, the modular construction of the fuel nozzle air swirler 20 allows for the cap 34 to be replaced independently from the body 22. The cap 34 may be disassembled from the body 22 by reversing the assembling methods described above. In the case where the cap 34 is welded to the body 22, the weld may be removed by grinding prior to disassembly. If the cap 34 cannot be disassembled from the body by reversing the above assembling methods because of excessive fretting damaged, corrosion or other reasons, grinding may again be used to destroy and/or break away the cap 34 from the body 22. The damaged cap 34 may then be disposed of and replaced by a new one while the body 22 may be left in place and subsequently reused.

Both the cap 34 and the body 22 may be manufactured using metal injection molding (MIM) techniques out of the same or different materials depending on the mechanical properties and high temperature properties that are desired for each part. The material for the cap 34 may be selected so as to more efficiently withstand the harsh environment in comparison with the body 22. Hence, a suitable but cheaper material may be selected for the body 22. In addition to material costs, a person skilled in the art will recognize that tooling costs may also be reduced by producing the cap 34 and the body 22 separately in comparison with a unitary nozzle. In the modular case, the body 22 does not have to be replaced as often as the cap 34 and also simpler tooling is required for producing each part separately. For example, forming the slots 41 on the body 22 as opposed to through channels in a unitary nozzle significantly reduces the complexity of the moulds required for MIM.

Even though the latching mechanism shown in the figures comprises latches 38 and catches 32, one skilled in the art would recognize that other types of securing or latching mechanisms may also be used. A function of the interlocking members is to provide a positive interlocking arrangement between the cap 34 and the body 22 which prevents the cap 34 from being released in the combustor 16. Another suitable latching mechanism could include, for example, straight tangs provided on the cap 34 that extend towards the body 22 and are bent over the catches 32. Again, the tangs could also be spot welded or brazed to the body 22.

In addition, it is apparent that in some instances the type of interlocking members could be interchanged between the cap 34 and the body 22. For example, some or all of the latches 38 could be disposed on the body 22 instead of the cap 34 and the corresponding catches 32 could be disposed on the cap 34 instead of the body 22. Further, the number of latches 38 and corresponding catches 32 could also differ from what is shown in the figures. For example, a single annular catch could be provided on the cap 34 while one or more cooperating latches would be provided on the body 32. Other variations in the type and specific locations of interlocking members are also possible.

The above description is meant to be exemplary only, and one skilled in the art will recognize that changes may be made to the embodiments described without departing from the scope of the invention disclosed. For example, it is apparent that the present modular nozzle configuration could be applied to simplex or duplex air-assisted nozzles. Still other modifications which fall within the scope of the present invention will be apparent to those skilled in the art, in light of a review of this disclosure, and such modifications are intended to fall within the appended claims.

What is claimed is:

1. A modular fuel nozzle air swirler for a gas turbine engine, the nozzle comprising:

a body defining a fuel passage extending axially between an inlet end and a discharge end of the body, the discharge end having a peripheral end surface, the body having at least one first interlocking member; and an annular cap having a shoulder surface interfacing with the peripheral end surface of the body, the annular cap having at least one second interlocking member cooperating with the at least one first interlocking member, the second interlocking member surrounding the first interlocking member and defining a radial slot in which the first interlocking member is axially captively received, thereby axially retaining the annular cap on the body, the peripheral end surface of the body and the shoulder surface defining a plurality of through air channels.

2. The fuel nozzle air swirler as defined in claim 1, wherein the at least one first and the at least one second interlocking members comprise a catch and a cooperating latch, wherein the latch has an inside holding surface forming opposed axially closed ends of the radial slot, the catch being selectively engageable between said axial closed ends by rotating the cap relative to the body.

3. The fuel nozzle air swirler as defined in claim 2, wherein the cap is welded to the body.

4. The fuel nozzle air swirler as defined in claim 2, wherein the latch is resiliently bendable radially outwardly.

5. The fuel nozzle air swirler as defined in claim 1, wherein the at least one first interlocking member is welded to the at least one second interlocking member.

6. The fuel nozzle air swirler as defined in claim 1, wherein the cap and the body are made from different materials.

7. The fuel nozzle air swirler as defined in claim 1, wherein the air channels are circumferentially spaced about the fuel passage and the at least one first and the at least one second interlocking members comprise a plurality of catches and corresponding latches circumferentially distributed between the channels.

8. The fuel nozzle air swirler as defined in claim 7, wherein the catches are disposed on the body and the latches are disposed on the cap.

9. The fuel nozzle air swirler as defined in claim 8, wherein the catches are disposed adjacent to a radially outer portion of the peripheral end surface.

10. The fuel nozzle air swirler as defined in claim 9, wherein the channels comprise slots disposed across the peripheral end surface, each slot having a slot width that is greater than a width of its corresponding latch.

11. The fuel nozzle air swirler as defined in claim 10, wherein the cap and the body are welded together.

12. A fuel nozzle air swirler for a gas turbine engine, the nozzle comprising:

a body having a central fuel passage extending axially therethrough and exiting the body through a spray orifice; and an annular cap positively secured to the body via cooperating securing means provided on the cap and body, the cooperating securing means comprise at least one latch and at least one corresponding catch axially engaged one behind the other in axial locking relationship, the cap being prevented from being axially removed from the body by the engagement of the latch with the catch, the annular cap circumscribing the spray orifice, a plurality of through air channels being defined at an interface between the body and the annular cap and extending towards the central fuel passage.

13. The fuel nozzle air swirler as defined in claim 12, wherein the catch is disposed at a radially outward portion of the body.

14. The fuel nozzle air swirler as defined in claim 13, wherein the cooperating securing means further comprise a weld.

15. A fuel nozzle air swirler assembly for use in a gas turbine engine, the assembly comprising:

a body defining a central fuel passage extending axially between an inlet end and a discharge end of the body, the discharge end having a peripheral end surface, the peripheral end surface having a plurality of circumferentially spaced through slots extending substantially radially about the central fuel passage; and an annular cap having a shoulder surface for interfacing with the peripheral end surface of the body and cooperating with the slots to define through air channels, the cap being positively secured to the body via a latching mechanism provided on the cap and body, the latching mechanism comprises a plurality of latches and a plurality of corresponding catches axially engageable one behind the other in a locking relationship.

16. The assembly as defined in claim 15, wherein the catches are circumferentially spaced between the slots.

17. The assembly as defined in claim 16, wherein the cap and the body are welded together.

* * * * *